United States Patent [19]

Kokubo et al.

[11] 4,431,178

[45] Feb. 14, 1984

[54] PAPER SHEET ACCUMULATOR ASSEMBLY

[75] Inventors: Eiichi Kokubo; Makoto Yamazaki; Hiroshi Emori, all of Tokyo, Japan

[73] Assignee: Laurel Bank Machine Co., Ltd., Tokyo, Japan

[21] Appl. No.: 301,009

[22] Filed: Sep. 10, 1981

[30] Foreign Application Priority Data

Sep. 11, 1980 [JP] Japan ..... 55-126549

[51] Int. Cl.[3] ..... B65H 29/00

[52] U.S. Cl. ..... 271/187; 271/315

[58] Field of Search ..... 271/315, 187, 178

[56] References Cited

U.S. PATENT DOCUMENTS 4,052,053 10/1977 Hasegawa ..... 271/315 X 4,228,997 10/1980 Schoonmaker ..... 271/315

*Primary Examiner*—Richard A. Schacher

*Attorney, Agent, or Firm*—Fleit, Jacobson, Cohn & Price

[57] ABSTRACT

A paper sheet accumulator assembly for receiving paper sheets to accumulate the same to be ready for collective dispensation. The paper sheet accumulator assembly includes a plurality of paddle wheels each having a plurality of paddles overlapping each other. Paper sheets fed by a conveyer between the paddles as the paddle wheels rotate. A guide belt assembly is provided adjacent to the paddle wheels to restrain the free movement of the trailing ends of the paper sheets and to prevent the paper sheets from slipping out the paddle wheels. The guide belt assembly is driven to move at a speed substantially equal to the circumferential speed of the trailing free ends of the paddles so as to facilitate smooth travel of the paper sheets carried by the paddle wheels. The paper sheet accumulator assembly further includes a scraper plate disposed below the paddle wheels for scraping the paper sheets away from the paddle wheels, and a carrier plate for receiving the paper sheets scraped from the paddle wheels.

2 Claims, 6 Drawing Figures

PAPER SHEET ACCUMULATOR ASSEMBLY

BACKGROUND OF THE INVENTION

1. Field of the Invention

The present invention relates to a paper sheet accumulator assembly for accumulating paper sheets at an accumulation station to be ready for collective dispensation of the thus accumulated paper sheets. The assembly according to the present invention is of particular utility when used in a bank note dispenser, and the following description will be given with reference to a bank note accumulator assembly embodying the present invention.

2. Prior Art

In a bank note dispenser, bank notes are supplied from a plurality of bank note stackers containing different sorts of bank notes, and passed to a bank note accumulator assembly to be accumulated to form a bundle of bank notes containing required numbers of designated sorts of bank notes. The bank notes must be accumulated in good order. One of the known bank note accumulator assemblies currently in use will be described with reference to FIG. 1 showing a bank note dispenser 1 provided with a bank note accumulator assembly 2. The known bank note accumulator assembly 2 shown in FIG. 1 is arranged in the upper portion of the bank note dispenser 1, and includes paddle wheels 3 each having a plurality of paddles 4 overlapping each other. Bank notes 5 supplied by a feed device, not shown, are inserted between the paddle 4 of the paddle wheels 3. Each of the bank notes 5 is carried by the rotating paddle wheels 3 until its leading end 5*a* abuts against a scraper plate 6. Bank notes scraped away from the paddle wheels 3 are accumulated on a carrier plate 7.

However, in the known accumulator assembly referred to above, only the leading end portion 5*a* of each bank note 5 is inserted between paddles 4 of the paddle wheels 3, and the trailing end portions 5*b* of the bank note is left free. Upon rotation of the paddle wheels 3, the free end portion 5*b* moves along a substantially circular path 5*c*. The extension of the path 5*c* is considerably larger than the area enclosed by the circle drawn by the rotating free ends of the paddles 4. Some other devices, for example a sensor for detecting the bank notes, cannot be arranged within the extension of the circular path 5*c* since it would hinder the travel of the free ends 5*b* of the bank notes 5. Moreover, the circular path 5*c* described by the free end 5*b* of each bank note 5 is varied to enlarge the area of vacant space necessary for providing a region for accommodating the traveling free ends 5*b* of the bank notes 5. Provision of vacant space in the vicinity of the paddle wheels 3 inevitably increases the dimensions of the bank note accumulator assembly 2, resulting in an increase in the dimensions of the bank note dispenser 1.

SUMMARY OF THE INVENTION

Accordingly, it is one object of the present invention to reduce the vacant space necessary for accommodating the trailing ends of the paper sheets to a minimum.

Another object of the present invention is to provide a paper sheet accumulator assembly having a guide belt for restraining the free movement of the trailing ends of the sheets and concurrently for facilitating smooth travel of the sheets carried by the paddle wheels.

A further object of the present invention is to provide a paper sheet accumulator assembly having a guide belt for preventing the sheets from slipping out of the paddle wheels.

The improved paper sheet accumulator assembly provided by the present invention comprises a plurality of paddle wheels each having a plurality of paddles overlapping each other and adapted for rotation to receive paper sheets between the paddles, a guide belt driven to move at a speed substantially equal to the circumferential speed of the trailing free ends of the paddles and arranged adjacently to the peripheries of the paddle wheels, a scraper plate disposed below the paddle wheels for scraping the paper sheets away from the paddle wheels, and a carrier plate for receiving the paper sheets scraped from the paddle wheels.

A more complete understanding of the improved accumulator assembly of the present invention can be had by referring to the following description of a preferred embodiment thereof.

DESCRIPTION OF THE PREFERRED EMBODIMENT

Figure 1:
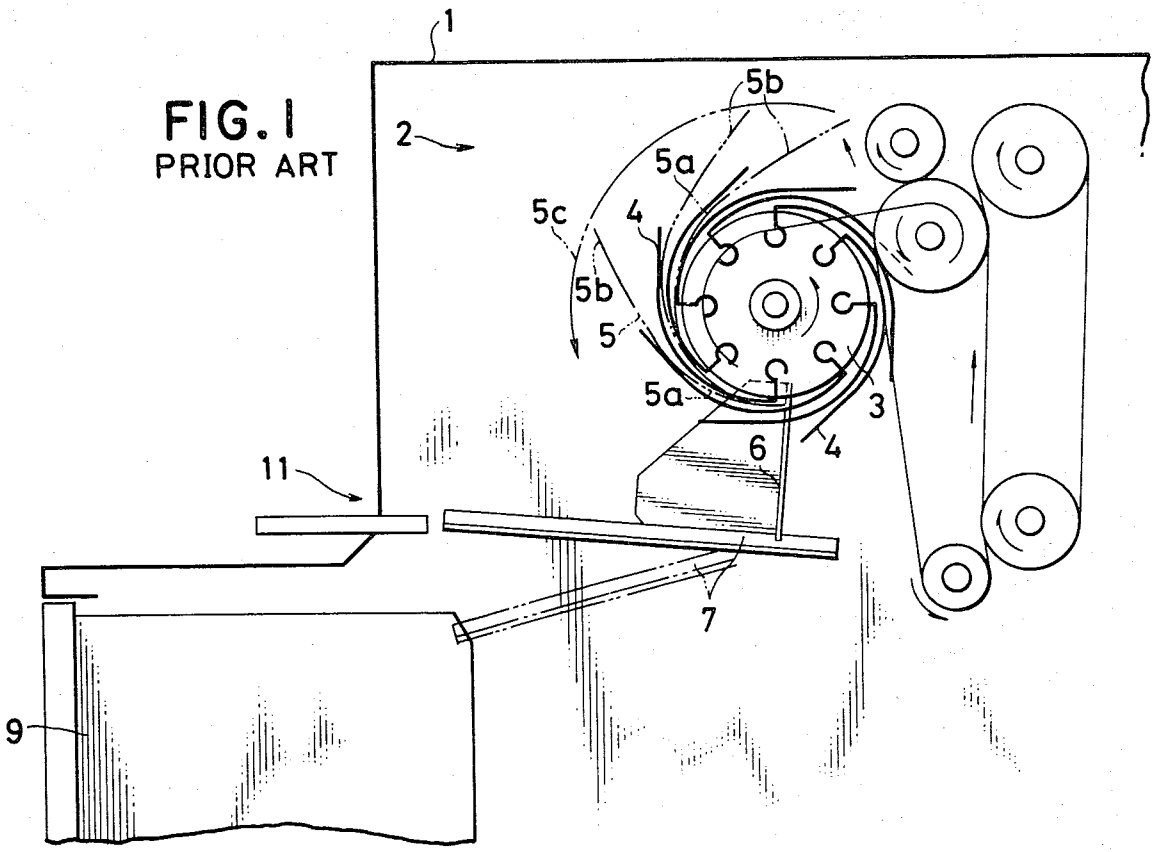
FIG. 1 PRIOR ART
FIG. 1 is a schematic representation of a bank note accumulator assembly of prior art which is the closest reference to the assembly according to the present invention.

The present invention will now be described in detail by referring to a preferred embodiment shown in FIGS. 2 to 6. In the Figures, similar parts are denoted by the same reference numerals.

Figure 2:
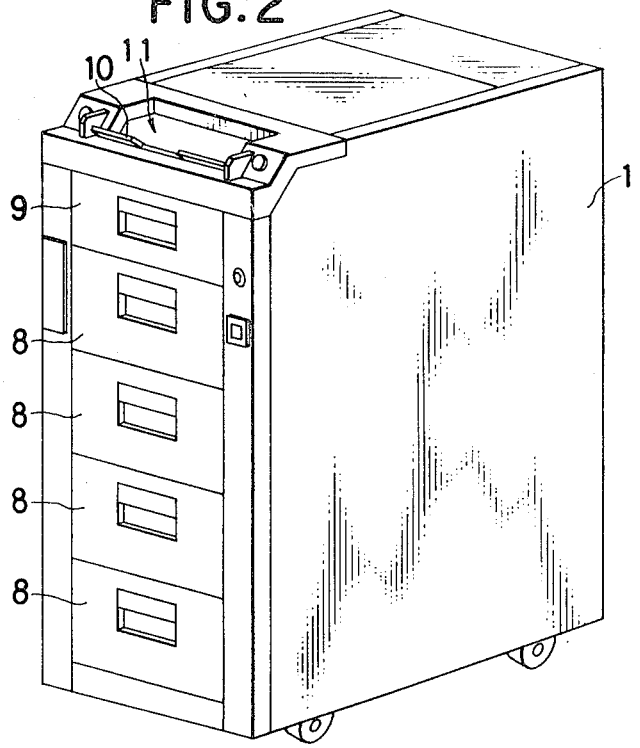
FIG. 2 is a perspective view showing the exterior of a bank note dispenser in which an improved paper sheet accumulator assembly according to the present invention is assembled.
Figure 4:
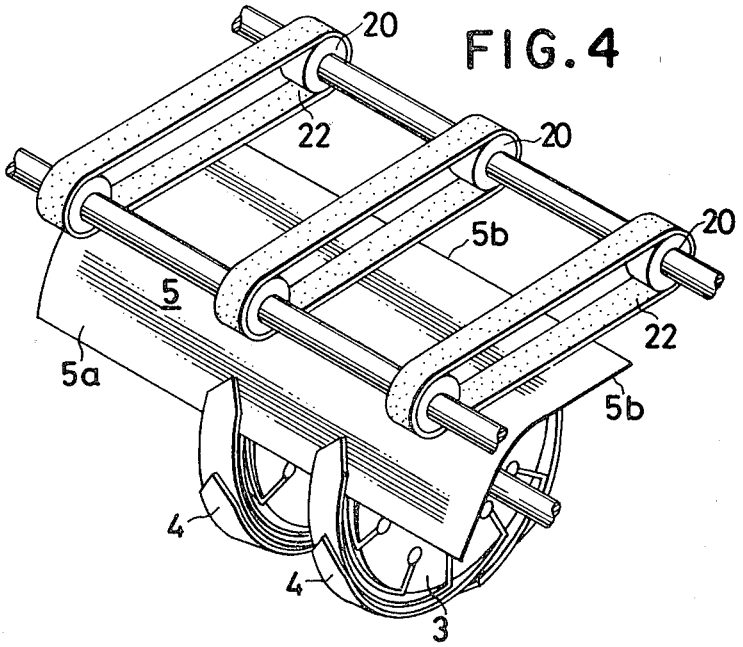
FIG. 4 is a perspective view showing a portion of the accumulator assembly shown in FIG. 3 with a bank note grasped in between the peripheries of the paddle wheels and the guide belt assembly.

Firstly referring to FIG. 2, a bank note dispenser 1 has a plurality of stacker or container boxes 8 for containing different sorts of bank notes. Each of the stacker boxes 8 is of drawer form and slidingly pushed into the housing of the dispenser 1. A reject box 9 is housed above the stacker boxes 8. A cash tray 10 is disposed at a discharge port 10 formed at the top portion of the housing.

Figure 3:
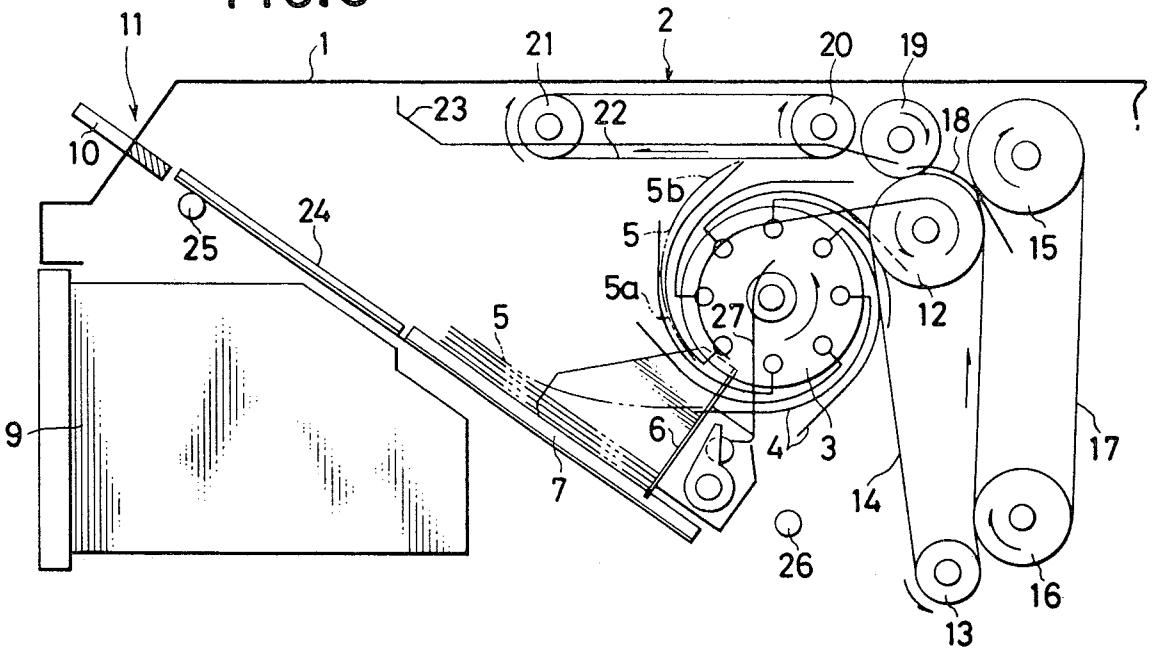
FIG. 3 is a sectional view showing, in somewhat diagrammatical representation, important parts of a paper sheet accumulator assembly according to the invention.

The present invention will be described more specifically with reference to FIG. 3 in which a bank note accumulator assembly 2 embodying the invention is shown. The accumulator assembly 2 includes a plurality of paddle wheels 3 which are combined with a conveyer assembly for conveying bank notes 5 supplied from the bank note stacker boxes 8 by a feed device, not shown. As shown, the conveyer assembly includes a conveyer belt 14 stretched over pulley rollers 12 and 13 and another conveyer belt 17 stretched over pulley rollers 15 and 16. The bank notes are conveyed between the upwardly-moving runs of the belts 14 and 17, and then guided by a guide plate 18 to be inserted between the paddles 4 of the paddle wheels 3. A rotating roller 19 engages with the belt 14 to facilitate smooth delivery of the bank notes 5.

According to the present invention, a guide belt assembly is arranged above the paddle wheels 3. The belt assembly of the illustrated embodiment has pulley blocks 20 secured to a rotating shaft, pulley blocks 21 secured to another rotating shaft, and guide belts 22 each being stretched over an opposing pair of pulleys 20 and 21. The lower run of each guide belt 22 is contiguous with the trailing ends of the paddles 4, and moves at a speed substantially equal to the circumferential speed of the trailing ends of the paddles 4. Reference numeral 23 designates a guide plate extending parallel to the lower runs of the guide belts 22.

A scraper plate 6 is arranged below the paddle wheels 3 and has lugs protruding between the adjacent paddle wheels 3. The leading ends of the bank notes 5 abut against the lugs of the scraper plate 6 to be scraped away from the underside of the paddles 4 to be accumulated on a carrier plate 7 one by one.

Figure 6:
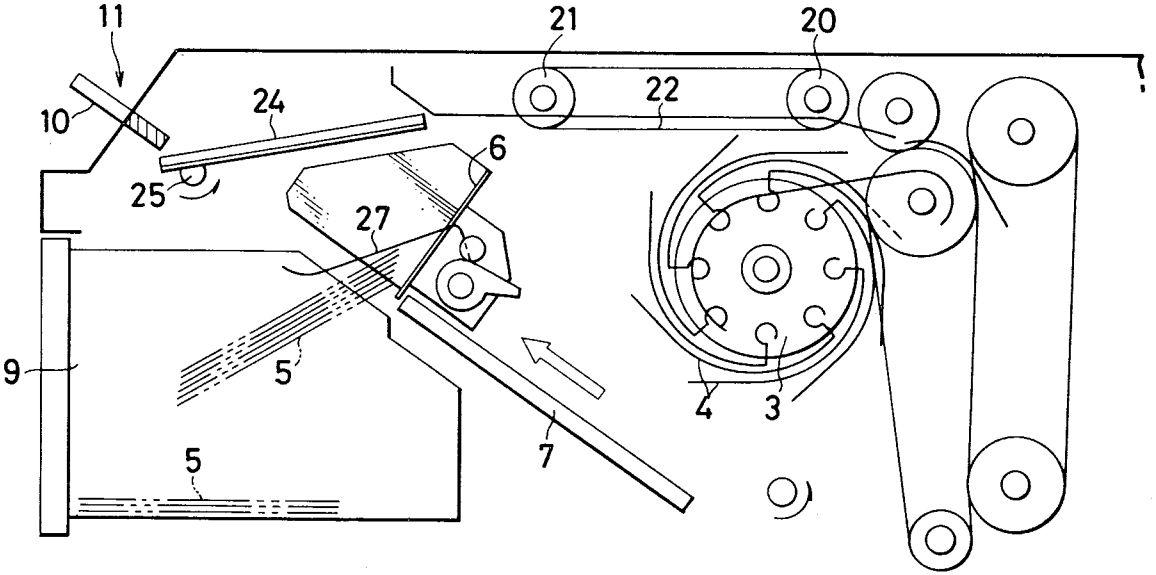

A gate plate 24 extends beyond the carrier plate 7 in normal operation condition and has a top face substantially flush with the top face of the carrier plate 7. However, the gate plate 24 is swung upwards, as shown in FIG. 6, about a shaft 25 to pass the bank notes 5 accumulated on the carrier plate 7 to the reject box 9 positioned beneath the gate plate 24. The shaft of a drive motor (not shown) for moving the scraper plate 6 along the ramp formed by the top faces of the carrier plate 7 and the gate plate 24 is schematically shown by 26, and a spring-biased arm for holding the bundle of accumulated bank notes is denoted by 27.

In operation of the bank note accumulator assembly 2, bank notes 5 supplied from the bank note stacker boxes 8 one by one are conveyed and guided by the belts 14, 17, the guide plate 18 and the roller 19 to be inserted between the paddles 4. As the paddle wheels 3 rotate, for example, in the counter-clockwise direction as viewed in FIG. 3, the bank notes are carried to a position at which the leading ends of the bank notes abut against the scraper plate 6. As the bank notes 5 are carried by the rotating paddle wheels 3, the trailing end portions 5*b* thereof contact with the lower run of the guide belts 22 which move at a speed substantially equal to the circumferential speed of the free ends of the paddles 4, whereby random expansion or repelling movement of the free ends of the bank notes is restrained to ensure reliable carrying operation. Therefore, the bank notes 5 are prevented from slipping out of the paddle wheels.

Figure 5:
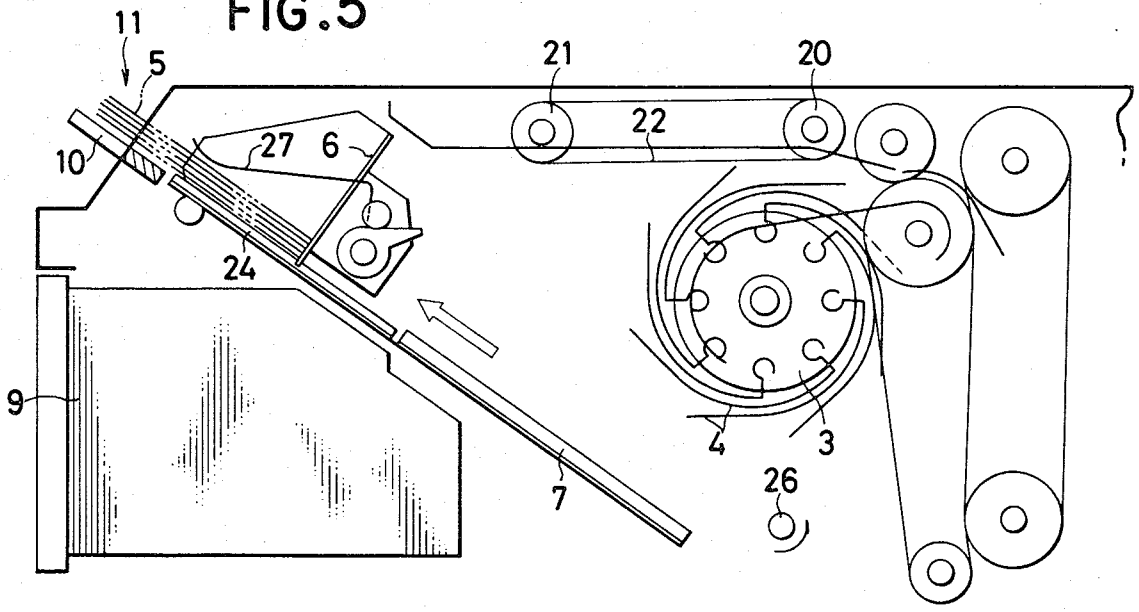
FIGS. 5 and 6 are schematic representations showing the operation of the bank note dispenser.

After the instructed number of designated sorts of bank notes have been accumulated on the carrier plate 7 and it has been ascertained that no error is involved in the operations, the accumulated bank notes are moved upwards by moving the scraper plate 6 along the ramp formed by the top faces of the carrier plate 7 and the gate plate 24 onto the cash tray 10, as shown in FIG. 5. If any error or malfunction is involved in the operations and detected by various sensors associated with the dispenser 1, e.g. when double supply or erroneous mixing of undesired bank notes is found, the gate plate 24 is swung about the axis 25 upwards, as shown in FIG. 6, to allow the accumulated bank notes to fall into the reject box 9.

The foegoing disclosure and the showings made in the drawings are merely illustrative of the principle of the present invention and are not to be interpreted in a limiting sense. For example, it should be clear from the foregoing that the accumulator assembly disclosed herein may be modified to handle sheets of paper or equivalent material. It will be also be apparent to those skilled in the art that the various modifications and changes may be made without departing from the spirit and scope of the present invention. It is, therefore, intended that all such modifications and changes be covered as they are embraced within the spirit and scope of the appended claims.

What is claimed is:

1. A paper sheet accumulator assembly for receiving paper sheets, said accumulator assembly comprising a plurality of paddle wheels each having a plurality of paddles overlapping each other and adapted for rotation to receive paper sheets between said paddles, a guide belt driven to move at a speed substantially equal to the circumferential speed of the trailing free ends of said paddles and arranged adjacent to the peripheries of said paddle wheels, said paddle wheels being of predetermined length to avoid contact with said belt, and said paper sheets, located between said paddle wheels, contacting said guide belt only at a trailing end of said sheets, a scraper plate disposed below said paddle wheels for scraping said paper sheets away from said paddle wheels, and a carrier plate for receiving said paper sheets scraped from said paddle wheels.

2. A paper sheet accumulator assembly according to claim 1, wherein said paper sheets are bank notes and the assembly is incorporated in a bank note dispenser.

* * * * *